US009744402B2

(12) United States Patent
Klassen

(10) Patent No.: US 9,744,402 B2
(45) Date of Patent: Aug. 29, 2017

(54) BALANCE TRAINING SYSTEM

(71) Applicant: James Brent Klassen, Langley (CA)

(72) Inventor: James Brent Klassen, Langley (CA)

( * ) Notice: Subject to any disclaimer, the term of this patent is extended or adjusted under 35 U.S.C. 154(b) by 0 days.

(21) Appl. No.: 14/935,062

(22) Filed: Nov. 6, 2015

(65) Prior Publication Data

US 2016/0199699 A1 Jul. 14, 2016

Related U.S. Application Data

(63) Continuation of application No. 13/056,639, filed as application No. PCT/CA2009/001043 on Jul. 29, 2009, now abandoned.

(Continued)

(51) Int. Cl.
*A63B 22/18* (2006.01)
*A63B 21/00* (2006.01)

(Continued)

(52) U.S. Cl.
CPC ..... *A63B 22/18* (2013.01); *A63B 21/4034* (2015.10); *A63B 22/16* (2013.01);

(Continued)

(58) Field of Classification Search
CPC ... A63B 26/003; A63B 21/4034; A63B 22/18; A63B 22/16; A63B 69/0002;

(Continued)

(56) References Cited

U.S. PATENT DOCUMENTS 3,604,726 A * 9/1971 Tracy ..... A63B 21/0004 280/205
3,862,768 A * 1/1975 England ..... A63B 21/0004 280/205

(Continued)

*Primary Examiner* — Sundhara Ganesan
(74) *Attorney, Agent, or Firm* — Christensen O'Connor Johnson Kindness PLLC

(57) ABSTRACT

Balance training systems and methods are disclosed. A balance training system is disclosed, comprising: a lower member having a ground contacting surface and an upward facing surface; an upper member having a foot receiving surface and a downward facing surface; the upward facing surface and the downward facing surface being shaped for contact with each other; and the upper member having a balance position when a balance point on the upper member is in contact with the lower member. A balance training system is also disclosed comprising a first platform having a top surface (ground plane) which supports the user's weight, a support having flexible and/or compressible upward facing surface in contact with a downward facing surface of the first platform, the ground plane being within 0.5" of the top surface of the flexible and/or compressible upward facing surface to reduce or prevent horizontal movement of the ground plane when the first platform changes angle. A balance training system is further disclosed, comprising a first platform having a top surface (ground plane) that supports the user's weight, a curved downward facing convex surface of the first platform, the top surface being aligned within ½" of the downward facing curved surface.

24 Claims, 19 Drawing Sheets

Related U.S. Application Data

(60) Provisional application No. 61/176,113, filed on May 7, 2009, provisional application No. 61/102,870, filed on Oct. 6, 2008, provisional application No. 61/084,420, filed on Jul. 29, 2008.

(51) Int. Cl.

| | |
|---|---|
| ***A63B 22/16*** | (2006.01) |
| ***A63B 26/00*** | (2006.01) |
| *A63B 22/00* | (2006.01) |
| *A63B 69/00* | (2006.01) |
| *A63B 69/36* | (2006.01) |
| *A63B 71/06* | (2006.01) |

(52) U.S. Cl.

CPC ..... *A63B 26/003* (2013.01); *A63B 22/0015* (2013.01); *A63B 69/0002* (2013.01); *A63B 69/0022* (2013.01); *A63B 69/0071* (2013.01); *A63B 69/36* (2013.01); *A63B 2071/0655* (2013.01); *A63B 2208/12* (2013.01)

(58) Field of Classification Search

CPC . A63B 22/0015; A63B 69/0071; A63B 69/36; A63B 2071/0655; A63B 2208/12; A63B 69/0022

See application file for complete search history.

(56) References Cited

U.S. PATENT DOCUMENTS

| | | | | | |
|---|---|---|---|---|---|
| 3,895,794 | A * | 7/1975 | England | A63B 22/16 | 482/146 |
| 4,191,371 | A * | 3/1980 | Armer, Jr. | A63B 21/0004 | 482/146 |
| 4,759,542 | A * | 7/1988 | Hudec | A63B 22/16 | 482/146 |
| 5,125,880 | A * | 6/1992 | Peters | A63B 69/18 | 482/146 |
| 5,582,567 | A * | 12/1996 | Chang | A63B 22/16 | 482/132 |
| 7,775,952 | B1 * | 8/2010 | Curran | A63B 22/18 | 482/146 |
| 7,857,740 | B2 * | 12/2010 | Suaste | A63B 21/0004 | 482/142 |
| 2004/0224824 | A1 * | 11/2004 | Lickle | A63B 26/003 | 482/51 |
| 2007/0254789 | A1 * | 11/2007 | Odien | A63B 21/0058 | 482/146 |
| 2008/0242515 | A1 * | 10/2008 | Odien | A63B 21/0058 | 482/34 |

* cited by examiner

BALANCE TRAINING SYSTEM

TECHNICAL FIELD

Balance training systems, useful for a variety of sports in which a person requires balance in order to effectively play the sport.

BACKGROUND

The ability to maintain one's balance is critical to sports performance and every day living. There are a number of different ways that humans naturally maintain their balance.

There are three main modes of balance correction employed by humans. For simplicity of explanation, all examples here are for a static standing mode. Rotational acceleration of body mass is used for angular attitude correction. In this mode of balance correction, rotational arm swing acceleration is most commonly used to cause a rotational acceleration of the body in the opposite direction. CG (Center of Gravity) correction is used to move the CG over top of the desired CF (Center of Force). This is commonly accomplished naturally by humans at low disturbance levels by moving the hips horizontally to keep the CG as directly over the preferred CF as possible. Platform correction is used to keep the preferred CF under the CG without necessarily moving the CG. At high disturbance levels, this can involve taking a step forward or backward or sideways to move the platform back under the user's displaced CG to "catch one's balance." At low disturbance levels, simply changing the CF of the foot contact area is all that is necessary to keep the CF as close as possible to below the CG. This can be accomplished by applying more pressure to the toes or the heels or one or the other sides of the foot.

Various combinations of these modes can be used at the same time. CG correction is the most natural method of balance correction and requires low amounts of energy. It is, however, not the ideal mode of balance correction for many sport activities because it requires movement of the upper or entire body system which can affect the precision of the movement and power transfer through the upper body.

SUMMARY

Platform correction is the ideal mode of balance correction for many aspects of many sports such as, but not limited to, golf and basketball because it can be accomplished by simple and precise ankle movements which resulting a change of the CF under the feet and cause minimal disturbance on the rest of the body. This stable platform generated from the ground up, allows higher precision and power transfer through the rest of the body. This allows the upper body movement to be dedicated more completely to the task rather than detracting from the task by also using the upper body for maintaining balance.

According to an embodiment, there is provided a balance training system, comprising a lower member having a ground contacting surface and an upward facing surface having an apex, the ground contacting surface providing stabilization of the lower member against tilting; an upper member having a foot receiving surface and a downward facing surface; the upward facing surface and the downward facing surface being shaped for contact with each other; and the upper member providing a support for a person to train balancing when a point or area on the upper member is in contact with the apex of the lower member. The upward facing surface and the downward facing surface may be shaped for rolling contact with each other. Preferably, one or more portions of one or both of the upward facing surface and the downward facing surface are convex and the upward facing surface and the downward facing surface are shaped for contact with each other at least along the one or more portions of one or both of the upward facing surface and the downward facing surface. The ground contacting surface may also provide resistance against rotation.

In an embodiment, the downward facing surface has a first radius of curvature at the balance point or is flat with infinite radius of curvature; the upward facing surface has a second radius of curvature at the apex; and the second radius of curvature is smaller than the first radius. The balance training system may include a stability zone or rocker zone. The balance training system may be for one foot, or two, and may have more than one surface contact forming the contact interface between upper and lower members.

In an embodiment, there is provided a balance training system, comprising a first platform having a top surface (ground plane) which supports the user's weight, a tilting support which allows the first platform to change angle, the tilt axis being aligned or nearly aligned with the top surface of the first platform to reduce or prevent horizontal movement of the ground plane when the first platform changes angle.

In an embodiment, there is provided a balance training system comprising a first platform having a top surface (ground plane) which supports the user's weight, a support having flexible and/or compressible upward facing surface in contact with a downward facing surface of the first platform, the ground plane being within 2", 1", ½", ¼" of the top surface of the flexible and/or compressible upward facing surface to reduce or prevent horizontal movement of the ground plane when the first platform changes angle.

In an embodiment, there is provided a sliding or rolling sport balance training system with a single or multi-direction tilting platform resting on a member which is able to move freely in one or more directions.

In an embodiment, there is provided an angle change platform with a flat or curved downward facing surface in rolling contact with a lower member stabilized against titling and having a convex upward facing surface. The combination of lower member curved surface and upper member curved surface may include an area of greater radius curvature at or near the apex of the lower member surface than the areas on one or more sides of the larger radius curvature. which results in a "stability zone" when the platform is horizontal or near horizontal where the CG of the user does not advance ahead of the contact point, when the platform tilts and the position of the users center of gravity does not change relative to the platform, at all or as much as when the contact point is in the correction zone/s on one or more sides of the stability zone.

The upper and lower members forming the angle change platform or balance training system may be made of compressible material, and may be biased relative to each other by a spring force. A relatively thin upper member is preferred. In another embodiment, a balance training system is provided comprising a first platform having a top surface (ground plane) which supports the user's weight, a curved downward facing convex surface of the first platform, the top surface being aligned within 2", 1", ½", ¼" of the downward facing curved surface.

In another embodiment, there is provided a balance training system, comprising: an upper member having a foot receiving surface and a downward facing convex surface;

the upper member providing a support for a person to train balancing on when a point or area on a contact zone of the upper member is in contact with a supporting surface; and the contact zone having an apex and a changing curvature across the contact zone. The contact zone may have a greater curvature member at an apex of the contact zone than at areas surrounding the apex. The contact zone may have a first curvature in a first direction away from the apex and a second curvature, different from the first curvature, in a second direction away from the apex. A lower member may comprise the supporting surface. The lower member may have portions that allow the lower member to slide or roll on a surface.

A balancing method is also provided, and the device may be used for golf swing training, golf putting stroke training, baseball swing training, balance or stability training, rehabilitation, basketball shooting training, or sports movement training.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 5:
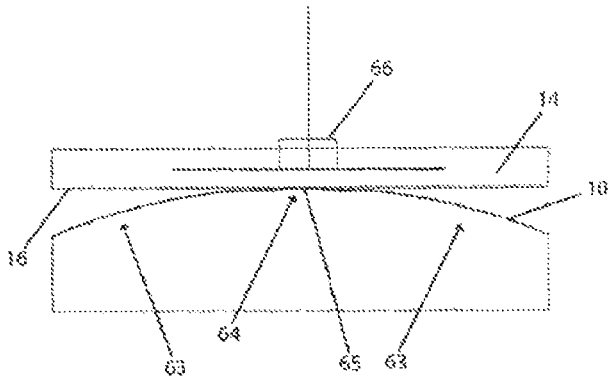
FIG. 5 is a side elevation view of a 2nd embodiment of FIG. 1.

Immaterial modifications may be made to the embodiments described here without departing from what is covered by the claims. The following features may be present in one or more of the disclosed embodiments. The balance training system may be used to train the user to maintain balance and stability through movement of the lower extremities such as the ankles and knees instead of by moving the upper extremities such as the hips and arms. This offers a significant advantage to athletes in many sports where balance correction in the lower extremities has been shown to result in a reduction of balance related movement in the upper extremities; this allows the upper extremities to achieve more precise and consistent movements. This has been shown to be noticeably and measurably beneficial in sports such as, but not limited to golf, basketball and skating sports. Increased stability through lower extremity balance correction has also been shown, through experimentation, to have a noticeable effect on the rehabilitation of unstable lower extremity injuries.

The balance training system is believed to cause the user to make intuitive/instinctive balance corrections using ankle movement instead of CG or other balance mode corrections. It does this by creating an artificial regulated instability in the direction of imbalance which, in order to maintain or regain balance in embodiments where the balance axis passes through both feet in a normal stance (feet side by side, approximately shoulder width), requires the user to push down more on the toes or the heels or one or the other sides of their feet.

Another feature believed by the inventor to occur in use of at least some of the disclosed embodiments of the balance training system is the minimization or elimination of extraneous horizontal movement of the users feet as the platform changes angle. This is done by constructing the balance training system in such a way as to position the rolling or pivoting contact of the platform as close as possible to the vertical position of the sole of the users shoes or feet. This is the "ground plane" effect and it serves to train the same proprioceptive feedback as when the user is standing on solid ground. This is the ideal scenario for a balance training device because it simulates, as closely as possible, the forces and movements that are required in actual life or sport performance.

Another feature of embodiments of the balance training system is a stability zone which is perceptible to the user when the platform is at or near horizontal. This stability zone is a larger radius curvature (as compared to the curvature outside the stability zone, that feels similar to a flat spot to the user. It helps the user to recognize where the desired platform position is and trains the lower extremities to search for and maintain that position.

This "stability zone" provides a positive feedback to the user to make them aware of when they are in the correct position. The size of the stability zone can be set or adjusted for easier balance training with a larger stability zone, or more precise balance training with a smaller stability zone.

By standing on the platform (and especially if also practicing certain athletic motions such as a golf swing) the user is trained to adjust their foot pressure to keep their center of gravity in a very controlled position without the need to move their upper body.

Figure 1:
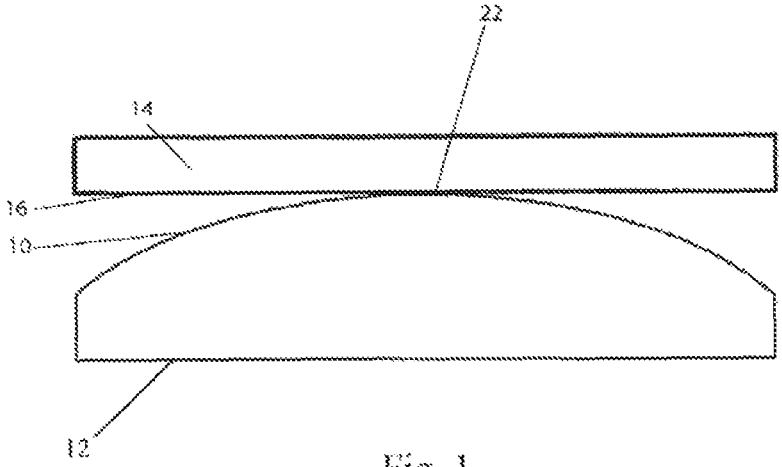
FIG. 1 is a side elevation view of a 1st embodiment of a balance training system.

FIG. 1 shows a simplified schematic diagram of a preferred embodiment of the balance training system 8. This artificial regulated instability is created with an upper or upward facing convex surface 10 on a lower member 12 which supports a platform 14 by means of preferably flat surface 16. The platform or upper member 14 forms a foot receiving surface, while the lower member 12 has a ground contacting surface. The lower member 12 is stable, namely that it retains its angular position during use. Hence, the lower member may translate laterally, but does not tilt. The ground contacting surface provides stabilization of the lower member against tilting, and preferably also rotation. The foot receiving surface (for example labeled as element 92 in FIG. 6) may receive one or both feet of a person and in the case of both feet, then with the feet spaced apart, parallel and approximately shoulder width apart, as seen in FIG. 7 for example. The ground contacting surface may be arranged to slide on the ground, as for example using wheels as in FIG. 8, or be fixed on the ground. It is preferred that the ground contacting surface be fixed in a direction parallel to the balance axis. The balance axis is side to side in FIGS. 2-5. In the balance position shown in FIG. 1, the apex 22 of the lower platform 12 forms a balance position. The apex is the point/s or line/s or area/s of the upward facing curve that are at the highest altitude with respect to the ground. When the upper member 14 is balanced on the lower member 12, a balance portion, a point or small area, of the upper member 14 (also shown at 22 in FIG. 1) is in contact with the apex 22 of the lower member 12 forming a contact interface between the upper member 14 and lower member 12. The downward facing surface 16 has a first radius of curvature at the balance point, which as shown in FIG. 1 is infinite. The upward facing surface 10 has a second radius of curvature at the apex. In the embodiment of FIG. 1, and preferably, the second radius of curvature is smaller than the first radius. The apex may form a point or line contact 22, or may correspond to a flattened region of the upward facing surface.

A convex or concave or irregular surface 16 can also be used as long as the upward facing surface 10 is designed to mesh with the downward facing surface 16 in such a way that the net effect of the surface engagement results in a similar effect to a convex upward facing surface 10 and flat downward facing surface 16. The combination of upward facing convex surface 10 and downward facing surface 16 shape result in the platform 14 being unstable enough to require movement of the user's ankles to correct his or her balance, but not so unstable as to require upper body movements such as movement of the arms. It can be seen that as the platform 14 changes angle, the contact point (or line or patch) between the lower member 36 and the downward facing surface 16 travels along the convex surface 10. Thus, as the platform changes angle, the contact point/s or line/s or area/s between the lower member and the downward facing surface travels with a horizontal component along the convex surface. In some embodiments, the contact point (or line or patch) between the lower member and the downward facing surface travels a greater distance for a given platform angle change in a first direction than it does for a platform angle change in a different direction. In some embodiments, the contact point (or line or patch) between the lower member and the downward facing surface travels a greater distance for a given platform angle change in a first direction than it does for a platform angle change in a different direction that is 90 degrees to the first angle.

Figures 2, 3, 4:
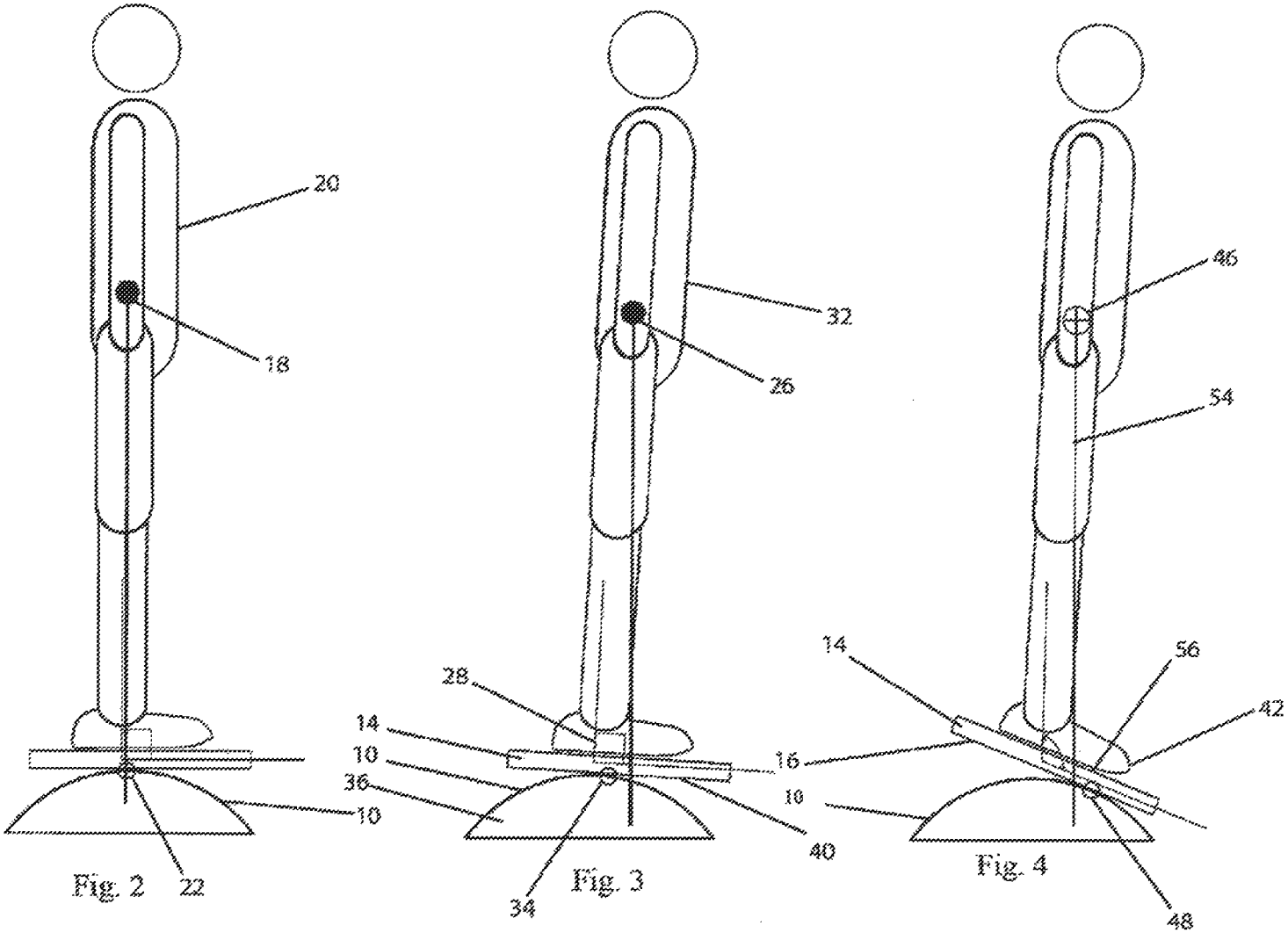
FIGS. 2-4 are side elevation views of the embodiment of FIG. 1 with a user.

This artificial regulated instability is achieved and defined in the following manner as illustrated schematically in FIGS. 2 through 4. In FIG. 2, the CG 18 of the user 20 is shown centered and in balance with his CG directly vertically above the preferred balanced position 22 which is located at the apex of the upper curved surface 10.

In FIG. 3, the user is shown off balance with his CG 26 horizontally displaced from the preferred balance position 22. If the user were to remain rigid without changing the angle of his ankles 28 and the platform 14 in relation to his body 32 his CG 26 will move horizontally further from point 22 (shown in FIG. 2) than the contact point 34 between the upper surface 10 and the platform lower surface 16.

If the user does nothing to correct this imbalance, he will fall forward off the platform. The vast majority of users will, however, naturally and instinctively sense that they can regain their balance by pushing down on their toes 42. This results in a rolling/tilting of the platform 14 in the direction of the user's imbalance as shown in FIG. 4. This, in turn, results in the contact point 48 between the surface 16 and the surface 10 rolling/tilting to a position which is horizontally more forward from position 22 (shown in FIG. 2) than the line 54 vertically downward from the user's CG 46. This moves the user's CF 56 forward enough to allow the user to bring his CG 18 back over the preferred balance position 22 to regain his balance.

With a properly designed balance training system as disclosed in this document, the user will sense that they are off balance in a direction (for example, forward) and naturally push down on their toes to compensate. The further they are off balance, the greater the angle they must use (or, in some embodiments, the more force they must exert) to bring their CF 34 under the CG 26 (to maintain balance) or past the CG 48 (to correct balance). This taps into the body's natural, but often unrefined, ability to maintain balance by changing the position of the center of force under the feet. It also trains the vestibular system and the proprioceptive systems to anticipate and make as small of corrections as possible (from the ankles only) in order to keep the CF 23 under (or as close as possible to under) the CG 18.

It has been shown by experimentation that users who have used this balance training system for as short as a minute or two, immediately feel an improvement in their balance and stability when they step off the balance system and onto solid ground. The ankle movement muscles and proprioceptive nerve systems which have been trained on the balance system disclosed herein react noticeably more precisely and quickly to any user imbalance and make it unnecessary, for low level disturbances, to resort to balance modes other than fine platform balance correction by changing the CG position under their foot or feet. This leaves the user's upper body free to complete sport or life activity movement with more precision, power and safety.

The curvature of the upper or upward facing surface 10 allows this effect to be natural and effective for the user. Too small of an arc radius on surface 58 and CG correction or rotational inertia balance correction modes will be naturally recruited by the user. Too large of an arc radius and the angle change platform becomes too stable and does not require platform correction, by platform 60 angle change relative to the user, to maintain balance.

It has been found through experimentation that an effective curvature in one or more directions for a range of users from adults to children is a 25 cm radius arc for the upward facing surface 10 (or the effective arc of the combination of the surface 10 and surface 16), for example when used as a forward/backward single direction rolling/tilting platform 14. A smaller radius is more challenging and a surface 10 radius as small as 7 cm is challenging for a trained athlete in the forward/backward direction while a radius as small as 1 cm has been shown to be highly challenging for a trained athlete in the lateral direction for a single foot balance training system as disclosed here. A larger radius arc for surface 10 (or the effective arc of the combination of the surface 10 and surface 16) is less challenging but possible. If the arc is significantly larger than 25 cm, the user may no longer need to change the platform 14 angle to maintain balance and the system may not work according to the principles of the balance training system disclosed here.

Referring to FIG. 5, a large radius may not be useful for the entire curved surface 10, but it is preferable in an embodiment of the invention which uses a larger arc (or other compound curve or spline) radius near the apex 65 to create a stability zone 64. An example of an embodiment that uses a stability zone is shown in FIG. 5. In this embodiment, a stability zone is created by the use of a flat spot, concave area, or preferably, by an arc or curve with a larger radius at or near the preferred balance position than on one or both or all sides of the apex position 65 corresponding with the preferred balance angle 66. This stability zone gives the user tactile feedback to alert them to when the platform is horizontal (or in some other desired angular position). This trains proprioceptors in the lower extremities to recognize the "ground plane" so they can maintain this position more precisely when standing (or skiing, etc.) on a solid or more stable surface.

An example is given in this disclosure of an ideal combination of arc radiuses for a golf balance training device. This curvature has been found to work well for many other activities such as, but not limited to, for rehabilitation for sprained ankles. Other combinations or single curvatures can be determined for specific activities by experimentation using the basic guidelines described in this disclosure.

A preferred combination of curvatures which has proven to be effective for a range of users from adults to children is a 25 cm radius arc for the correction zone 63 on one or both sides of the stability zone 64 and a 75 cm radius arc stability zone 64 with a width (or more specifically, an arc length) of 2.5 cm. The intersections of these arcs preferably have a smooth transition, such as a radius of 10 cm to blend the motion from the correction zone arcs to the stability zone arc.

A wider stability zone will make for a more forgiving but less precise training device.

Figure 6:
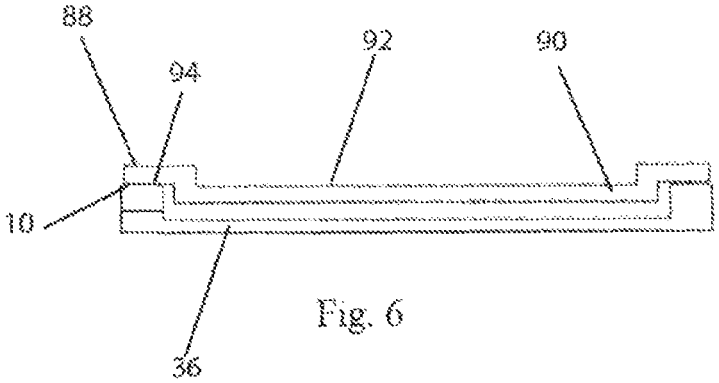
FIG. 6 is a side elevation view of a 3rd embodiment of a balance training system, which may in cross-section have the configuration of FIG. 1 along the contact interface between the upper and lower members.
Figure 7:
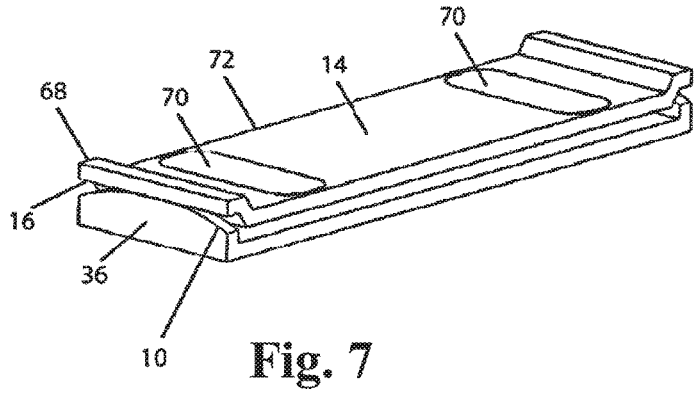
FIG. 7 is a perspective view of the embodiment of FIG. 6.

In FIG. 6, which shows a cross-section of an embodiment of a balance training system, the upper surface 88 of the platform 90 is offset from the upper member 90 with the rolling engagement lower surface 94. This aligns the "ground plane" 92, which corresponds with the top of the platform 90, with the radiused rolling surface 10 also referred to as the upward facing surface 10 of the lower member 36. The advantage of this feature is to reduce or eliminate horizontal movement of the top of the platform as it tilts during balance correction. The benefit of this is to simulate very closely, with the balance training system, the proprioceptive feedback and muscle reactions that will be experienced when the user is on solid ground.

A similar but less precise effect can be achieved by using a platform with no offset by using a very thin cross section where it contacts the upward facing surface 10. This brings the "ground plane" 92 as close as possible to the radiused contact surface 10 without the cost or complexity of an offset member 90. Cross section areas have been used successfully with a thickness of between 5 mm and 10 mm. Thinner or thicker may also be used but as the platform becomes significantly thicker than 10 cm, the performance and effect are noticeably reduced.

Figure 10:
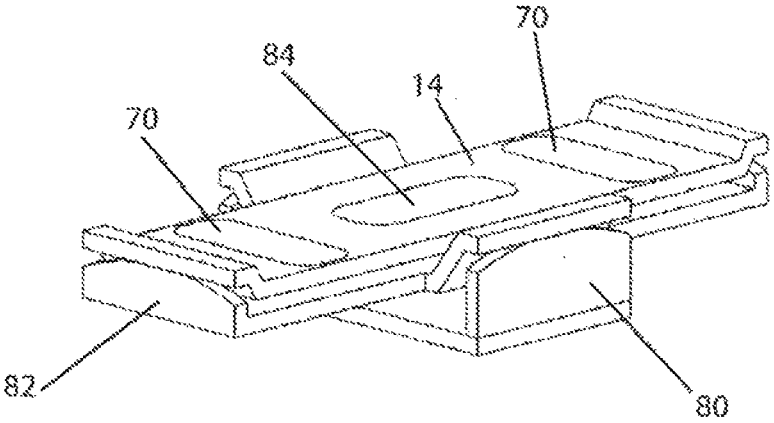
FIG. 10 is a perspective view of a combination of the 3rd and 5th embodiments.

In FIG. 7, an embodiment of the balance training system is shown with a single axis movement for two feet. In this embodiment, the "ground plane" feature is accomplished by using an offset member 68 at each end of the platform 14 to align the upper surface 10 of the lower member 36 with the top surface 72 of the platform 14. This reduces or eliminates the horizontal movement of the top of the platform 14 to more precisely train the proprioceptive system of the lower extremities. The preferable foot position is shown by the two foot pads 70 but other foot positions can also be used. This embodiment of the invention has been found to be useful for sideways sports such as golf training with a driving wood or iron. In the embodiments of FIGS. 7 and 10, the upper member and the lower member contact each other on portions that are convex to each other and are spaced on either side of a foot receiving area of the upper member.

Figure 8:
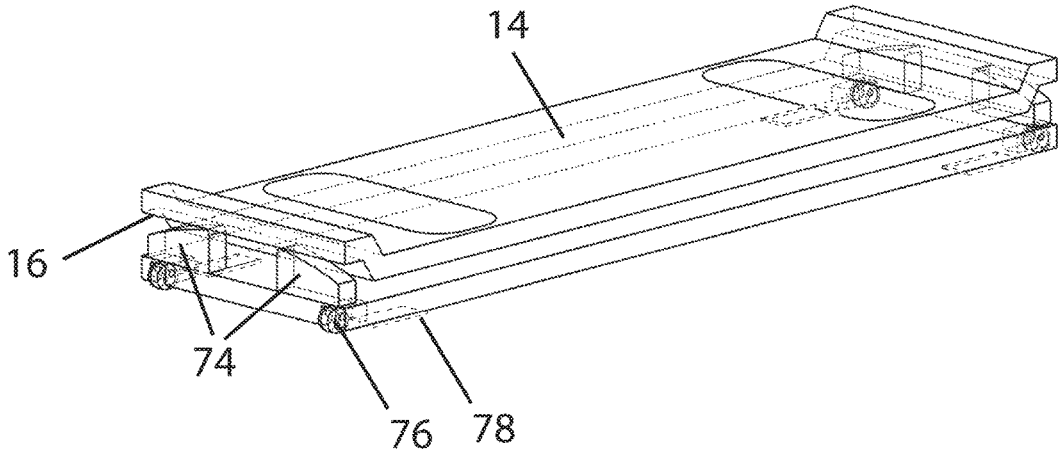
FIG. 8 is a perspective view of a 4th embodiment of a balance training system.

FIG. 8 shows a similar embodiment to the balance training system in FIG. 7 with two additional features. An adjustable stability zone is achieved by using a split lower member 74 which can be adjusted closer together (for a shorter "flat" spot) or further apart for a larger and more stable "flat spot." Wheels 76 are used to add a linear axis of movement for specific movements such as a driving motion in golf. In this case, pushing the hips forward causes the platform 14 to roll backwards. The result is a natural reaction of the user to prevent the wheel from rolling by not shifting their hips sideways. This has been shown to be a very helpful training tool for golfers who slice. Wheels are the preferable method of achieving a linear axis movement. Sliding pads 78 of a low friction material, such as but not limited to Teflon™ are illustrated schematically as an alternative to wheels in FIG. 8.

Figure 9:
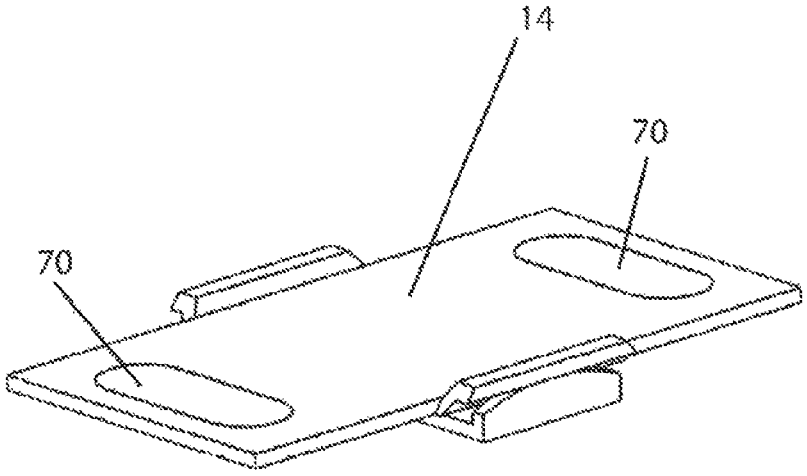
FIG. 9 is a perspective view of a 5th embodiment of a balance training system.

In FIG. 9, a single axis balance training system is shown with the platform 14 rolling/tilting axis inline with the user when they are standing with one foot on each of the foot pads 70. This embodiment has been shown to increase free-throw accuracy for basketball and to increase the position and stability of many other sport and life movements.

In FIG. 10 a multi axis balance training system is shown. In this embodiment, upward facing members 80 are used to support another set of upward facing members 82 which supports the platform 14. With these two movement axes, the platform is able to tilt in any direction and can be used with two feet as shown by the foot pads 70, or with one foot as shown with the foot pad 84. This multi axis balance training system has been shown by experimentation to be very useful to achieve better ground sense and accuracy for various sports and life movements. Shooting a free throw in basketball and archery are two of many examples. In the embodiment of FIG. 10, the upper member and lower member may have a contact interface configured to provide differential tilting in a first direction and a second direction different from the first direction. This may be achieved by providing the upward facing surfaces of the members 80 and 82 with different radii of curvature.

Figure 11:
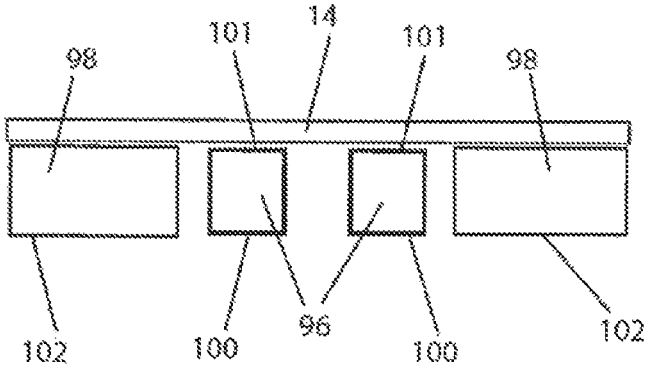
FIG. 11 is a side elevation view of an 6th embodiment of a balance training system.

In FIG. 11, the lower member/s 96 are a resilient or flexible or compressible material or combination of materials that do not necessarily have a curved upper surface 10 but by virtue of its compressibility which will be greater around the outer edges 98 results in a similar effect to the curved upper surface 10 of the rigid lower member 36 in FIGS. 1-10. In this embodiment, flexible or compressible foam or semi rigid member/s 96 provide more stability when the platform is near horizontal. More easily compressible foam 102 on one or more sides around the outside of the more rigid material provides less stability as platform angle increases.

In the simplified embodiment shown schematically in FIG. 11, foam strips (for a single axis angle change device) or foam circles or disks (for a multi-axis angle change device) are arranged to create an angle change platform with a stability zone at or near the horizontal position. Differential tilting in the embodiment of FIG. 11 may be achieved by having material 102 of one density in one direction, and a second set of material having different density on either side of the material 96, but out of the plane of FIG. 11. The contact region between the upper member 14 and lower members 96, 98 forms a contact interface.

The lower density foam 102 (or other compressible member such as extension and/or compression springs and/or elastics) requires more force to change the angle of the platform when the platform is significantly angulated from horizontal. "Significantly" in many applications may be for example approximately 2 degrees, although greater or lesser angles may be useful for certain types of training.

The platform is preferably as thin as possible to bring the ground plane (AKA top of platform) aligned as close as possible with the upper surface/s of the lower member/s.

Figure 12:
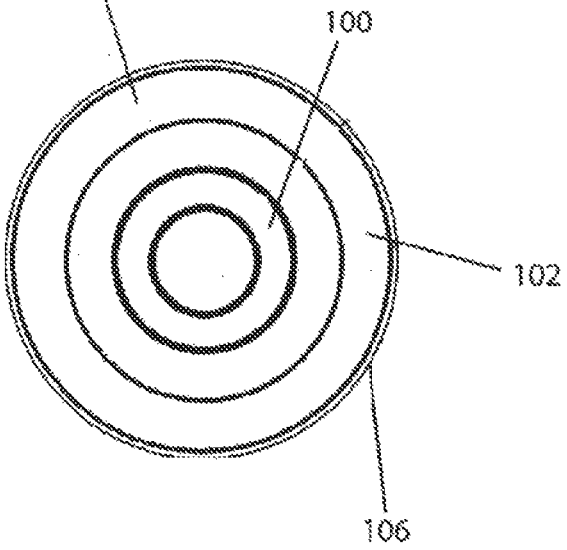
FIG. 12 is a bottom plan view of the 6th embodiment of a balance training system.

FIG. 12 shows a bottom view schematic of a multi axis configuration of the device in FIG. 11. Higher density foam 100 or semi-rigid flexible and/or compressible disk or ring provides the stability zone support when the platform is horizontal. As an example of an ideal material for this member, a 60-100 durometer (Shore A) urethane has an effective compression characteristic that makes it effective for this application for human balance and stability training. Many other materials or combinations of materials may also be used. A lower density foam 102 or more compressible material or combination of materials including more rigid materials in a configuration that is compressible such as springs or spring-like constructions is used around the outside of the semi-rigid center disk or ring 106. This gives the angle change platform 104 some support when it is off angle from horizontal but not so much as to make it completely stable. With the correct combination of materials, the user is challenged to keep the platform horizontal in the stability zone but still able to correct their balance as a result of changing the angle of the platform 104. Critical to the correct function of a foam or spring stabilized balance training device shown in FIGS. 11-13 is that as the more compressible the material/s around the outside of the center semi rigid disk or ring 100 requires more force to compress, the greater the angle of the angle changing platform is from horizontal.

Figure 13:
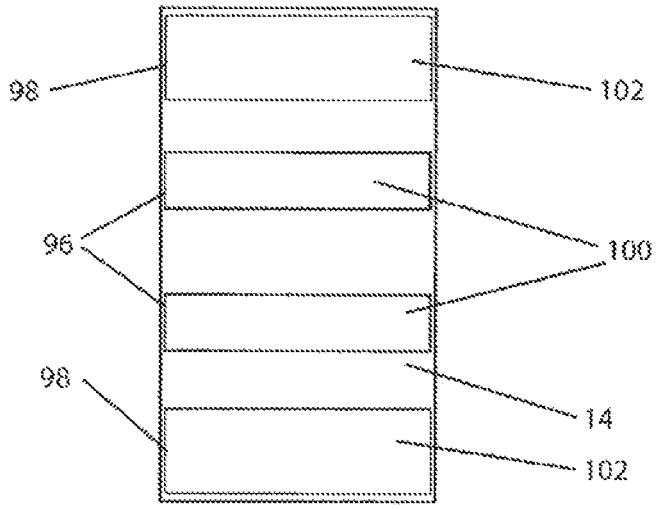
FIG. 13 is a bottom plan view of a 7th embodiment of a balance training system.

FIG. 13 shows a single or limited axis embodiment of the embodiment shown in FIGS. 11 and 12. In this embodiment, the platform 104 is biased to tilt in only one plane or at least to resist tilting in one or more planes. This is accomplished with a rectangular or oblong semi-rigid member/s 100 or combination of members that together combine to create a stability zone prevents or resists angulations of the platform in the longitudinal direction of the semi-rigid member/s 100 by virtue of the semi-rigid member/s 100 combining to create a shape that is longer in one direction than in the direction 90 degrees to that direction. The stationary rigid or semi rigid member/s 100 are intended to provide more stability near horizontal.

Figure 14:
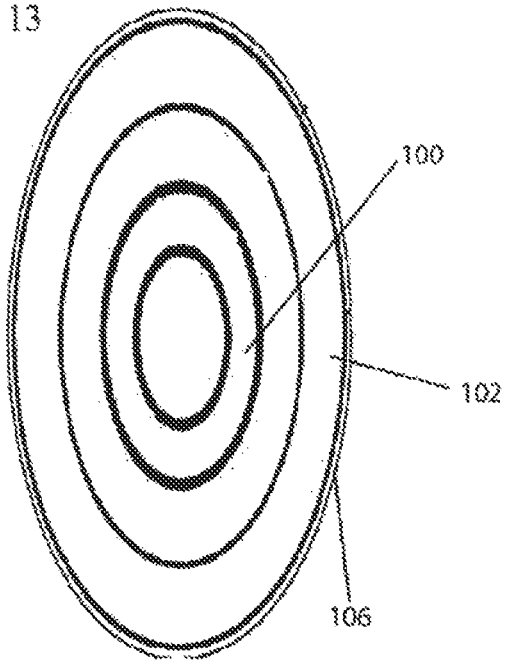
FIG. 14 is a bottom plan view of an 8th embodiment of a balance training system.

FIG. 14 shows a multi-axis embodiment of the balance training device shown in FIGS. 11 and 12. In this embodiment, the platform is biased to tilt with less effort in the side to side direction than in the front to back direction. This is accomplished with a non-round shape such as but not limited to, an oval or a teardrop shape. Many other shapes can also be used with various effects for different balance training uses. The non-round semi-rigid member 100 provides greater stability in the front to back direction than in the side to side direction. This has been shown to be ideally suited to one foot balance and stability training and rehabilitation because the average user is naturally able to make finer balance correction movements with their ankle from side to side in comparison to front to back motions.

A more compressible material or combination of materials such as foam or springs is preferably, but not necessarily, used on one or more sides of the semi-rigid member/s to provide an increasing supportive force as the platform angle changes. These outer member/s 102, will preferably have a greater supportive force in one or more tilting directions as compared to other tilting directions depending on the specific application. The foam or other compressible material can also be used to prevent angle change platform from sliding on stability zone member 100 when the platform is at an angle.

It should be noted that the semi rigid, but not necessarily curved upper surface, of member 10 as shown in FIGS. 1 through 10 can be used as the lower members in FIGS. 11 through 14 of this patent disclosure with beneficial effects such as the ability to offset the platform and align the top surface of the platform with the upward facing surface of the semi-rigid member 100.

Figure 15:
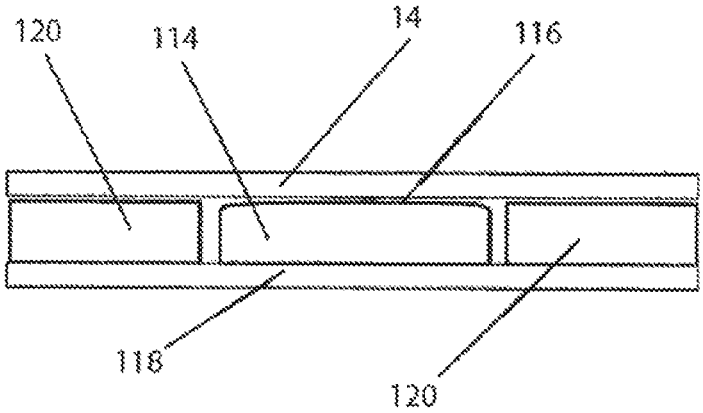
FIG. 15 is a side elevation view of a 9th embodiment of a balance training system.

FIG. 15 shows a preferred low cost embodiment of the balance training system which uses a rigid or semi rigid lower member 114 with a convex upper surface 116 with or without a larger radius stability zone. The platform 14 preferably, but not necessarily also uses a compressible material or combination of material or member/s such as but not limited to foam or leaf or coil springs to provide increasingly more vertical force on the platform to resist tilting of the platform 14 when the platform 14 is tilted at an increasing angle from horizontal. The foam, or other material or combination of materials can also serve to prevent the platform 14 from sliding sideways on the lower member 118. The foam, or other material or combination of materials can also serve to keep the lower member 118 in the correct position by preventing it from moving in one or more sideways directions relative to the platform 14 or the foam members 114 which are preferably fixed to the bottom of the platform 14 with some securing means such as, but not limited to, with adhesive or Velcro.

The foam, or other material or combination of materials can also be used to adjust the stability of the balance training system by using interchangeable members 120 with different compressibility or by adding or subtracting members to achieve various levels of force required to change the angle of the platform.

Figure 16:
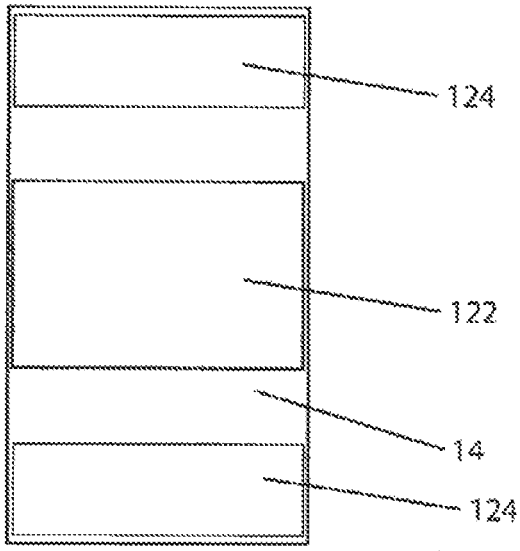
FIG. 16 is a bottom plan view of a 10th embodiment of a balance training system.

FIG. 16 shows a single or limited axis embodiment of the embodiment shown in FIG. 15. In this embodiment, the platform 14 is biased to tilt in only one plane or at least to resist tilting in one or more planes. This is accomplished with a rectangular or oblong rigid or semi-rigid member/s 122 or combination of members that together combine to create a convex upper surface 116 with or without a stability zone which prevents or resists angulations of the platform in the longitudinal direction of the rigid or semi-rigid member/s 122 by virtue of the rigid or semi-rigid member/s 122 combining to create a shape that is longer in one direction than in the direction 90 degrees to that direction.

Figure 17:
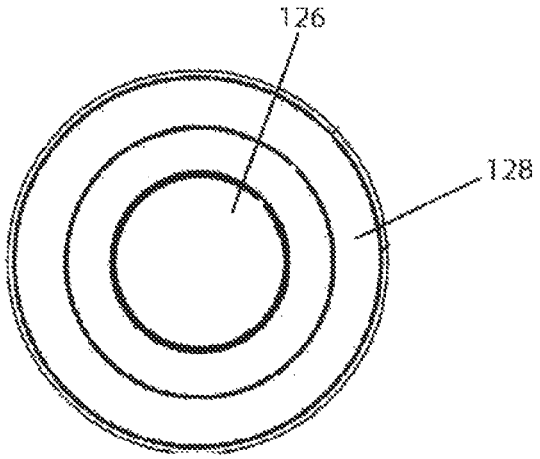
FIG. 17 is a bottom plan view of an 11th embodiment of a balance training system.
Figure 18:
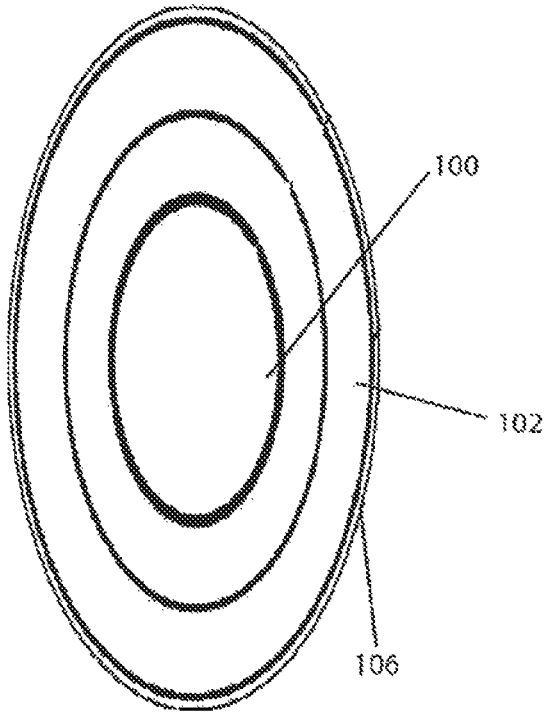
FIG. 18 is a bottom plan view of a 12th embodiment of a balance training system.

FIG. 17 shows a multi-axis embodiment of the balance training device shown in FIGS. 15 and 16. In this embodiment, the platform is biased to tilt with less effort in the side to side direction than in the front to back direction. This is accomplished with an upper surface convex curvature that has a larger radius of curvature in one direction than in the direction which is 90 degrees to that direction. Many other shapes can also be used with various effects for different balance training uses. A round shape 126 (viewed from the top) can have different upper surface curvatures in different directions, as can a non-round shape. The rigid or semi-rigid member 126 in this embodiment preferably provides greater stability in the front to back direction than in the side to side direction for certain applications and/or training techniques. This has been shown to be ideally suited to single foot balance and stability training and rehabilitation because the average user is naturally able to make finer balance correction movements with their ankle from side to side in comparison to front to back.

A more compressible material or combination of materials such as foam or springs 128 is preferably, but not necessarily, used on one or more sides of the rigid or semi-rigid member/s 126 to provide an increasing supportive force as the platform angle changes. These outer member/s 128, will preferably have a greater supportive force in one or more tilting directions, such as but not limited to forward and backward, as compared to other tilting directions, such as but not limited to side to side, depending on the specific application and balance or stability training purpose. The foam or other compressible material 128 can also be used to prevent the angle change platform from sliding sideways on the lower member 126, 100 when the platform 14 is at an angle.

It should be noted that the rigid or semi-rigid member 114,122 as shown in FIGS. 15 through 17 can be used as the lower members in FIGS. 6 through 10 of this document with beneficial effects such as the ability to offset the platform 14 and align the top surface 92 of the platform with the upward facing surface 101 of the rigid or semi-rigid member 100.

Figure 19:
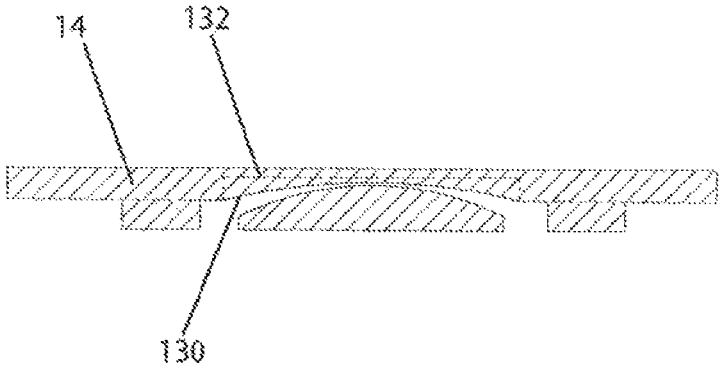
FIG. 19 is a side elevation view of a 13th embodiment of a balance training system.

In the schematic section view in FIG. 19, a method of reducing the effective thickness of the platform 14 while maintaining adequate strength and stiffness of the platform is shown. In this embodiment, the contact area of the downward face 130 of the platform is an indented pocket 132 (shown schematically with the dotted line) or has a concave shape that allow the outside of the pocket to be thicker and stronger, and the contact area to be as thin as the adjacently supported material will allow.

Figure 20:
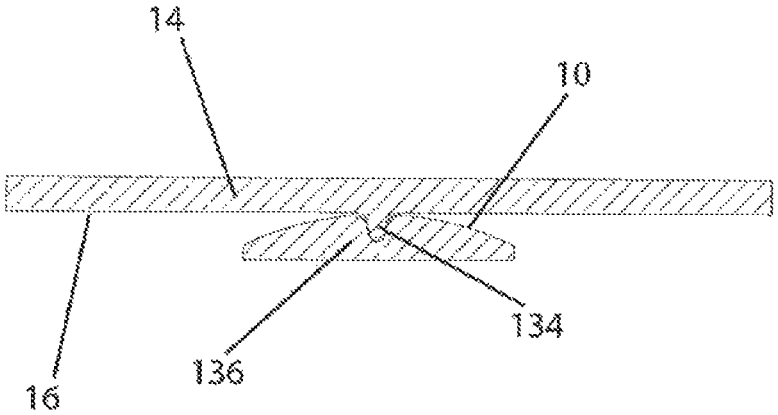
FIG. 20 is a side elevation view of a 14th embodiment of a balance training system.

In FIG. 20, a method of securing the platform 14 from sliding on the upward facing surface 10 of the lower member 136 is shown. In this embodiment, there is a preferably downward protrusion 134 that slides vertically in an arcing motion on the curved surface pocket which has a curvature which is defined by the end point of arcs which are at the contact point between the downward protrusion 134 and the curved surface 10 with an instantaneous arc center that is coincident with the contact point between the downward facing surface of the platform 16 and the upward facing surface of the lower member 136. This protrusion can locate the platform in one plane of movement or in multiple tilting directions. If a non-round protrusion and corresponding receiving pocket is used, then this feature can be used to prevent the platform from spinning on the lower member 136.

The upper surface 10 of the lower member 136 in this embodiment is preferably, but not necessarily a compressible or deformable material so the flat spot that is inherent in this embodiment will feel less abrupt to the user and therefore more challenging to sense.

Other methods of preventing the platform from sliding on the lower member include, but are not limited to, gear teeth, such as but not limited to, involute gear teeth on the upward facing surface 10 of the lower member 36 and the bottom surface 16 of the platform 14 or offset member 88 of the platform 90 and/or movement tangent to the curved upward facing surface 10 of the lower member 36. These gear teeth can even be circular or non circular but extending around the apex, or near the apex, in such a way that the platform 14 can tilt in any direction and not slide. An elastic member at the apex which pulls the platform toward the lower member is preferable for this and other embodiments for certain applications of this balance training system.

Other methods of preventing the platform from sliding on the lower member include, but are not limited to grip surfaces or roughened surfaces and or rough or uneven mating surfaces on the upward facing surface of the lower member 10 and/or the downward facing surface of the platform 14 or offset member 88.

Figure 21:
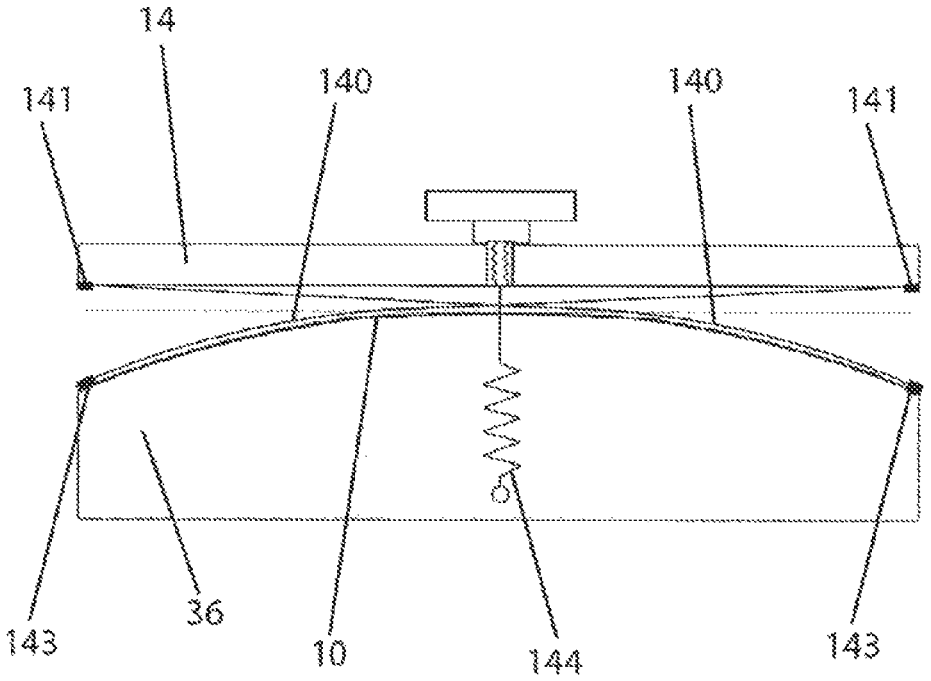
FIG. 21 is a side elevation view of an 15th embodiment of a balance training system.

In FIG. 21, an end view schematics of examples of a method of restricting horizontal movement and/or movement tangent to the curved upward facing surface 10 of the lower member movement of the platform 14 while allowing it to freely change angle is shown.

In this embodiment, there are preferably non elastic cables or cords or strapping 140 that is attached to one side 141 of the platform 14 and the opposite side 143 of the lower member 36. An opposing non elastic cable or cord or strap is attached to the other side of the platform 14 and the other side of the lower member 36 so each of the two non-elastic members 140 secures the platform in one of two directions. These crossed flexible members, such as cables, embodiment prevents horizontal movement of angle change platform.

This allows the platform 14 to roll with very little friction on the curved upward facing surface 10 of the lower member 36 without sliding.

An adjustable difficulty system is also shown in this embodiment. A spring 144 or elastic element is used to create an elastic force between the platform and the apex of the upward facing surface 10 of the lower member 36. This elastic force is preferably adjustable to create a more stable platform by increasing the spring or elastic member tension. This elastic member 144 tension can be used on any of the embodiments of the BTS included in this patent application. As shown, the upper member and lower member of the balance training system of FIG. 21 are shown apart, but in practice the spring draws the members into contact with each other.

Figure 22:
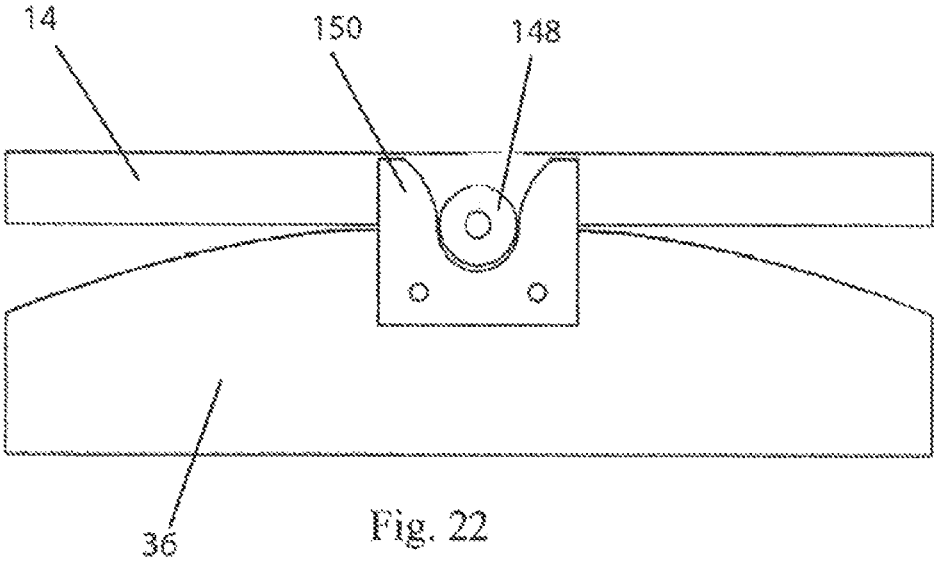
FIG. 22 is a side elevation view of a 16th embodiment of a balance training system.

In FIG. 22, a variation of the horizontal positioning system in FIG. 21 is shown with a bushing, bearing, pin or protrusion 148 which is secured to the angle change platform 14 preferably with axis aligned with or nearly aligned with the contact between platform 14 and arced contact member 36.

The guide member 150 is secured to the lower fixed member (in this embodiment example) and allows platform 14 to change angle without sliding in the direction of angle change.

Figure 23:
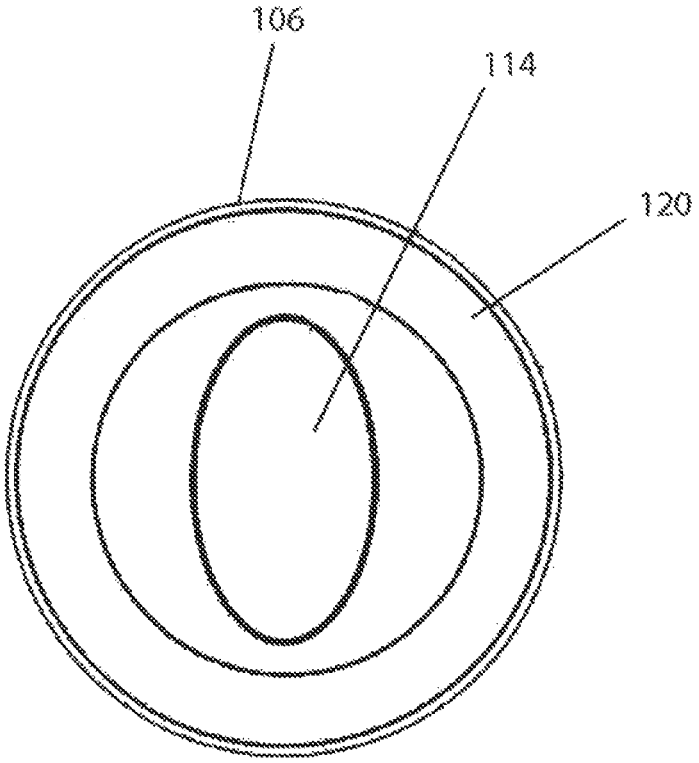
FIG. 23 is a bottom plan view of a 17th embodiment of a balance training system.
Figure 24:
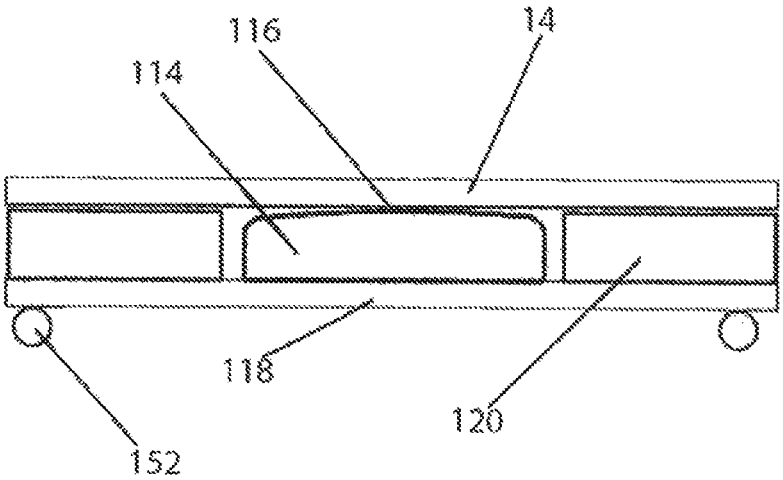
FIG. 24 is a side elevation view of a 18th embodiment of a balance training system.

A multi-directional embodiment of the BTS is shown in FIG. 23 with a rigid or semi rigid lower member 114 which has a smaller radius in the side-to-side direction than in the front to back direction. Note, in FIG. 24 a larger radius stability zone at or near the apex 116 of the curve is not necessary but will be beneficial in some applications. A smaller radius instability zone at or near the apex of the curve may be beneficial in some applications of this embodiment or other embodiments in this document.

The angle change platform 14 is as thin as possible in the area of the platform which is contacting the lower member 118 to reduce horizontal movement of the ground plane during angle change of the platform.

Foam 120 is optional and can also be used to prevent the angle change platform from sliding when platform is at an angle.

Wheels, rollers, or sliders 152, shown here schematically, can be also used to allow movement in one or more directions for certain applications such as, but not limited to, a ski or skating balance training device to more accurately simulate that movement with the BTS. Wheels or rollers or other sliding mechanisms are not preferable in many applications such as for sports where sliding or rolling is not part of the normal movement.

Figure 25:
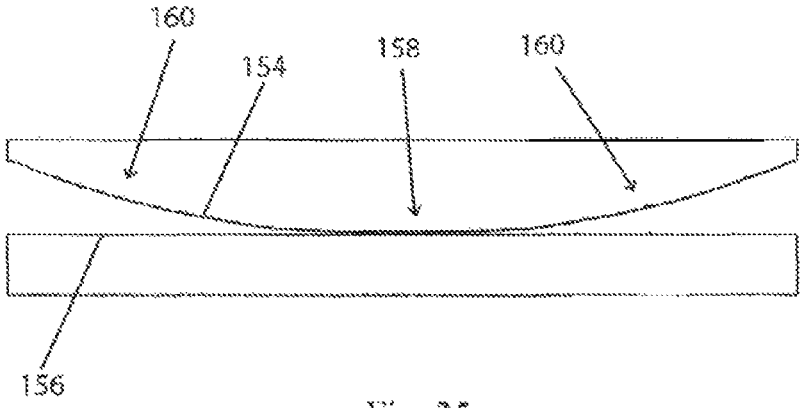
FIG. 25 is a side elevation view of a 19th embodiment of a balance training system, in which the lower member may be the ground or a floor surface.

In FIG. 25, a schematic view of an alternate embodiment that uses one or more principle of the BTS is shown. Unlike FIGS. 1-10, it uses a downward facing curved surface 154 on the tilting platform 156 that rolls on a preferably, but not necessarily float lower member upward facing surface. Similar to FIGS. 2-10, it uses a stability zone 158 with a larger radius than the correction zone 160 curvature on either side of the stability zone or surrounding the stability zone to give the user a tactile feedback of when the platform is horizontal. It can be seen that as the platform 156 changes angle, the contact point (or line or patch) between the lower member 156 and the downward facing surface 154 travels along the convex surface 154. The upper and lower platforms may thus have an effectively rolling contact without slipping in the rolling direction. In an embodiment of the balance training system, the upward facing surface and downward facing surface may both be convex, as long as the downward facing surface has a smaller average radius in the area of contact during normal use.

Figure 26:
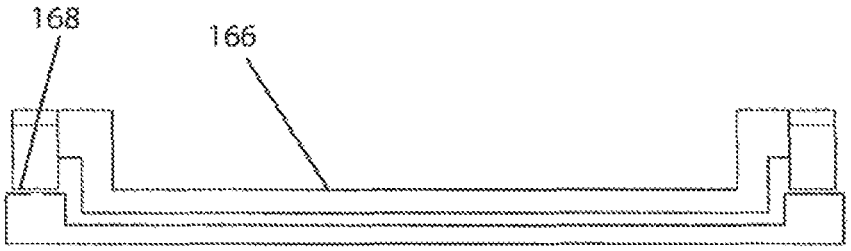
FIG. 26 is a side elevation view of a variation of the 19th embodiment of a balance training system.

In FIG. 26, the embodiment of FIG. 26 is shown with the preferred alignment of the ground plane 166 with the radiused rolling surface 168 to reduce horizontal movement of ground plane during platform angle changes. In the balance training system shown in FIG. 26, the downward facing curved surfaces (which is aligned with the ground plane) can be constructed with or without a stability zone. This embodiment works the same as the embodiment of FIG. 1.

For all of the embodiments disclosed here, the curved contacting surfaces can be an arc or combination of arcs or a parabolic or elliptical section or freeform surface which approximates the general principles of the BTS as described here.

Figure 27:
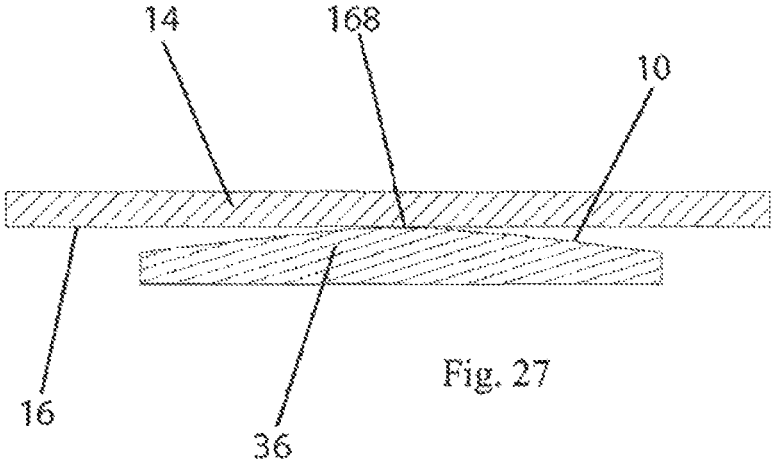
FIG. 27 is a side elevation view of a 20th embodiment of a balance training system.

FIG. 27 shows an alternate embodiment of the BTS where the apex 168 of the upward facing surface 10 of the lower member 36 has a smaller radius at or near it's apex as compared to the surrounding curvature which is in contact when the platform 14 is not horizontal to create an area of lower stability or rocker zone when the platform is at or near horizontal. This is not a preferable embodiment for many applications but is of use for certain very precise training applications for example with elite athletes who need a more challenging BTS.

For all of the embodiments in this disclosure with multiple direction angle change capability, it may be advantageous to have a stability zone/s with different characteristics in different directions. One example would be a single foot balance disk with a smaller stability zone in the side to side direction than in the front to back direction.

For all embodiments in this disclosure, it is preferable that the ground plane which supports the user's weight be aligned or nearly aligned (i.e. aligned more closely than if the angle change platform had no offset as shown in FIG. 4) to the instantaneous pivot axis of the angle change means. The instantaneous pivot axis may be, for example, the upward surface of the convex arc as in FIG. 4, the downward facing surface of the convex arc in FIG. 9, the "virtual instantaneous pivot axis" of the angle change platform as with the embodiment of FIG. 7, or the pivot axis of a pivoting angle change platform. In this way, the horizontal movement of the ground plane can be reduced or eliminated to more accurately simulate the effect of standing on solid ground.

Figure 28:
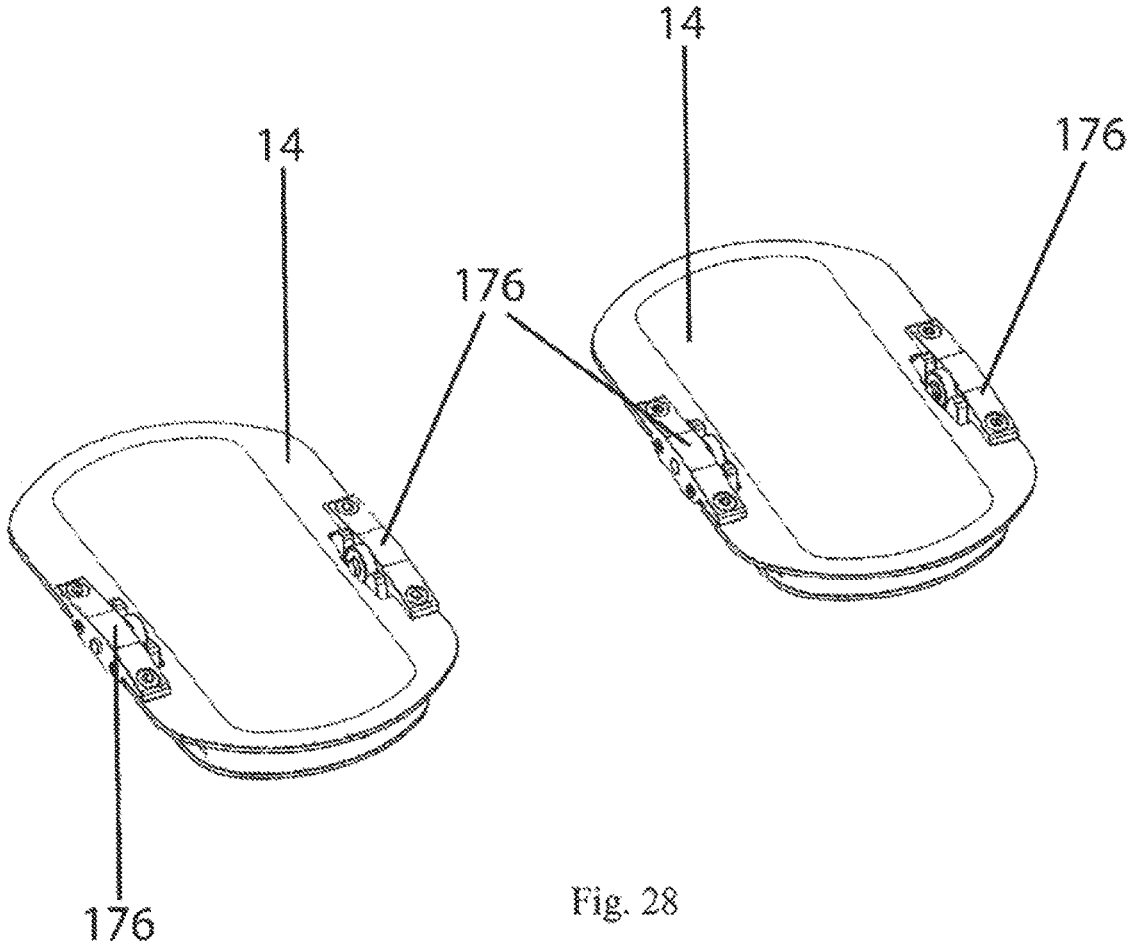
FIG. 28 is a perspective view of a 21st embodiment of a balance training system.
Figure 29:
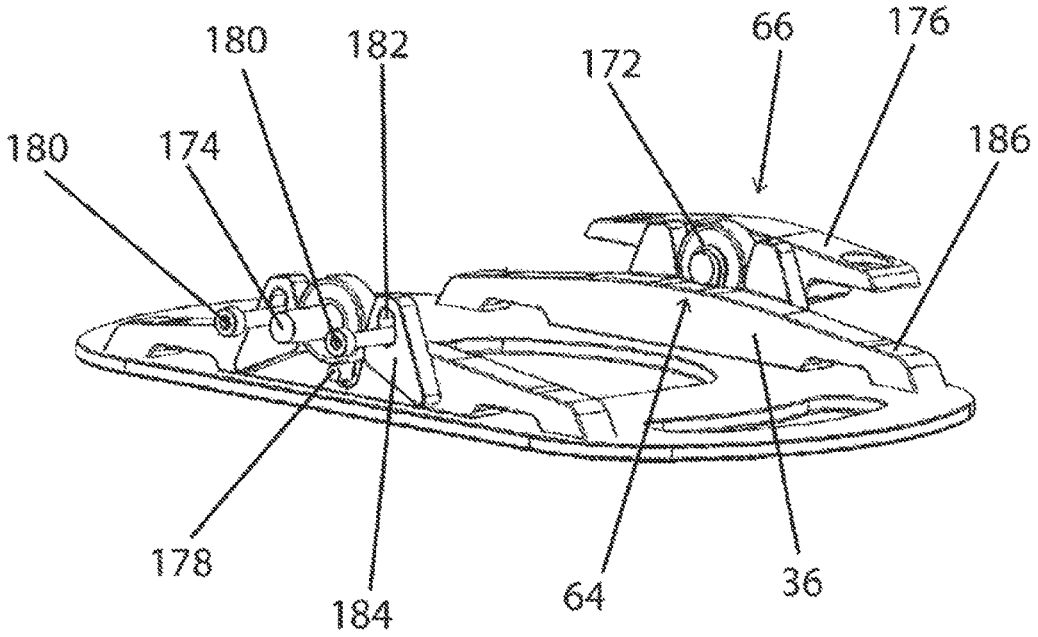
FIG. 29 is a perspective view of the 21st embodiment of a balance training system.

FIGS. 28 and 29 show a production version the BTS which is ideally suited to but not limited to training for a golf putting stroke. It has been shown by experimentation that the use of this device has a dramatic impact on putting accuracy and consistency. It consists of two separate foot pods that can be spaced for an individual user. A detailed view of one of the two pods is shown in FIG. 29 with some of the components removed for a better view of the lower member 36, stability zone 64, horizontal positioning system 66 as also shown in FIG. 5. Also shown in this embodiment is an elastic element 172 between the bearing shaft 174, which is secured to the platform by the bearing bracket 176, and a dowel pin 178 on the lower member 36. This elastic element 172 serves to keep the platform secured and in contact with the lower member 36. Rigid bolts, pins or protrusions 180 interface with slots 182 in the lower member extensions 184 to keep the assembly from disassembling. These slots are large enough to not create interference with the bolts 180 during normal use. The lower members preferably have a hard stop 186 to give the user tactile feedback when they are at the limit of the tilting angle of the platform 14.

Figure 30:
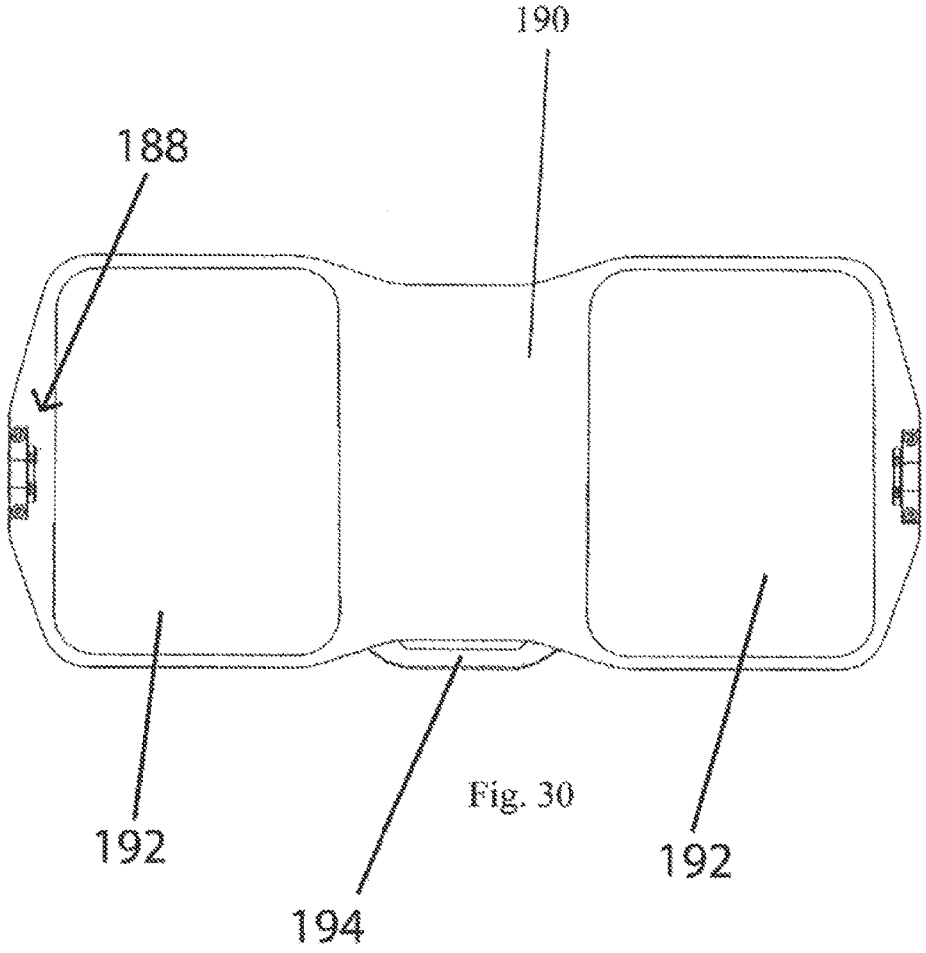
FIG. 30 is a top plan view of a 22nd embodiment of a balance training system.
Figure 31:
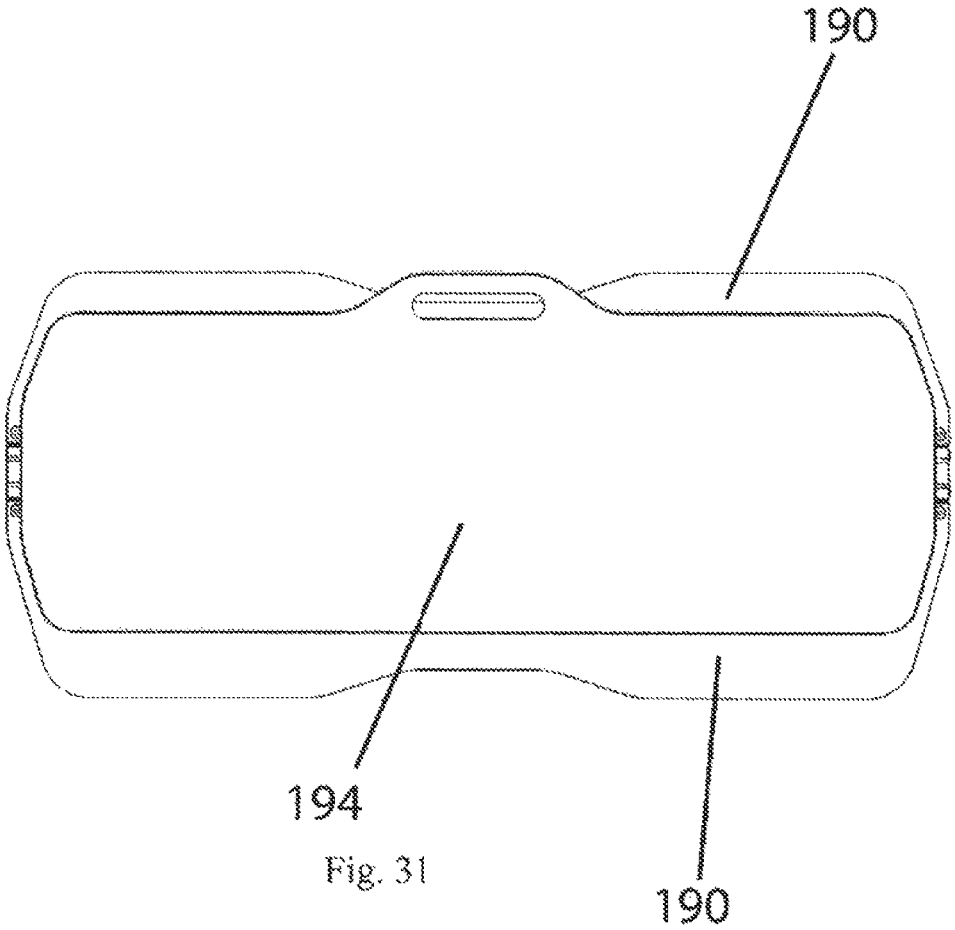
FIG. 31 is a top plan view of the 22nd embodiment of a balance training system.
Figure 32:
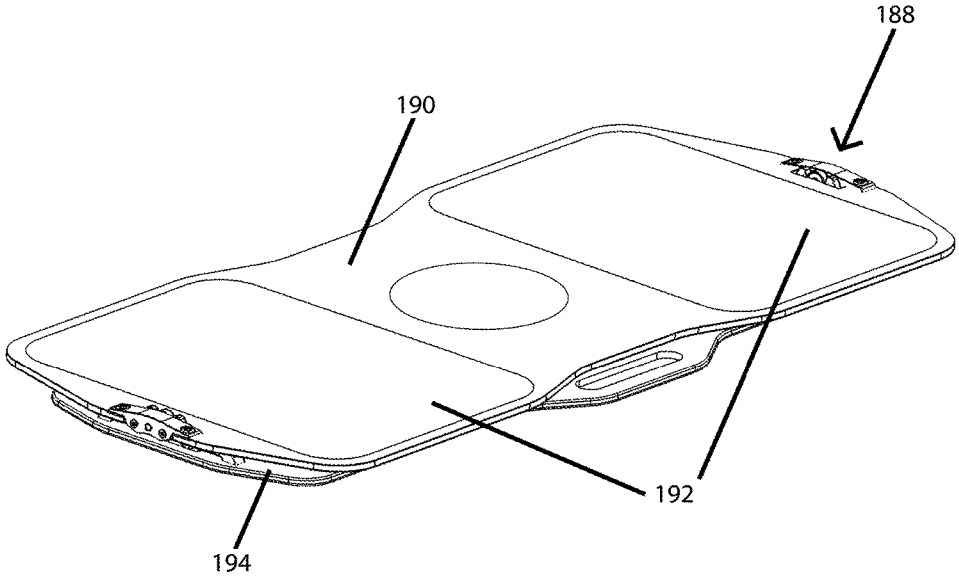
FIG. 32 is a perspective view of the 22nd embodiment of a balance training system.

In FIGS. 30 through 32, a two foot version of the BTS is shown which is ideally suited to motions such as, but not limited to a full swing in golf. It uses a similar articulation mechanism 188 similar to the separate foot version in FIGS. 28 and 29, but the platform is designed to resist torsional flex so each foot can move independently such as at the end of a drive stroke when a golfer will typically lift the heel of their back foot. Note that there is an articulation mechanism at both ends of the platform 190, but intermediate articulation devices can also be used between the footpads 192 to reduce the need for longitudinal strength and stiffness from the platform 190 material and construction. As a result of the use of principles of the BTS as described in this disclosure, Prototypes of this device have been shown to dramatically improve driving accuracy and consistency in the majority of test subjects.

It should be noted that the instantaneous center of rotation is preferred but not necessarily, as shown in FIGS. 1 through 32, in the center of the platform but toward the heel of the user. This is because the CG of the user is not ordinarily above the center of their foot, but more rather toward the back of the foot.

The BTS has been found to be very effective in training balance and stability. One of the main reasons is the proximity of the instantaneous center of rotation, as defined by the contact point or line or points between the upward facing surface of the lower member and the downward facing surface of the platform, with the ground plane which the user is standing on. It has been found by experimentation that a distance of ¼" or less is preferable between the instantaneous center of rotation and the ground plane when the ground plane is horizontal. Large distances, for example 2" 1" or ½' are less effective but still of benefit for certain balance training uses. In relation to FIG. 1, for example, this means that the foot receiving surface of the upper member is vertically spaced from the downward facing contact surface by less than 2" 1" or ½" or ¼".

Another reason of the effectiveness of the balance training system is that the curved convex surface is fixed while the flat surface it rolls against is what changes angle during use. In some cases, the platform will also have a curved contact surface. In this case, the contacting member which has the smallest average radius of curvature in the area of contact during normal use is the fixed member.

Figure 33:
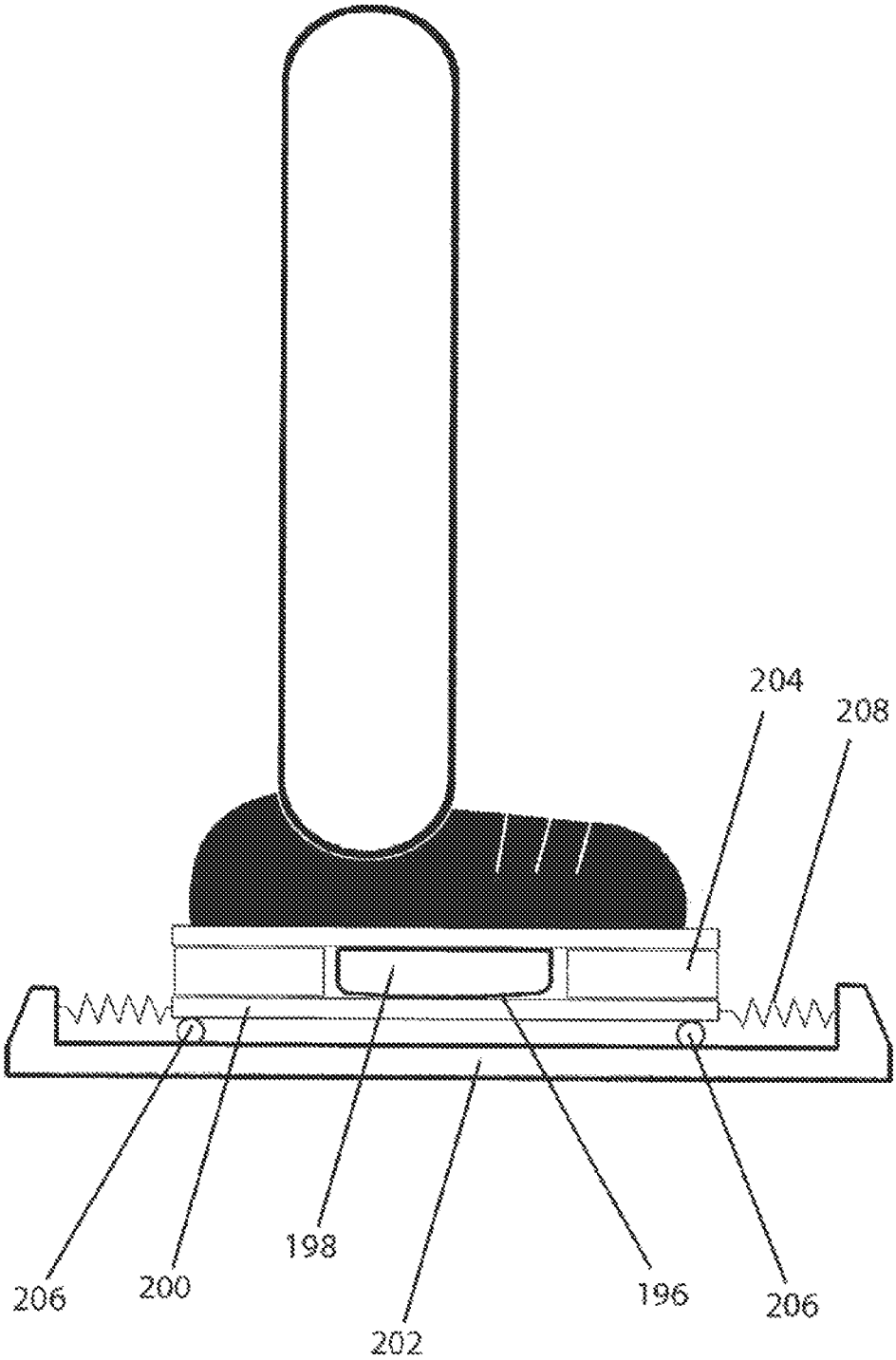
FIG. 33 is a side elevation view of a 23rd embodiment of a balance training system.
Figure 34:
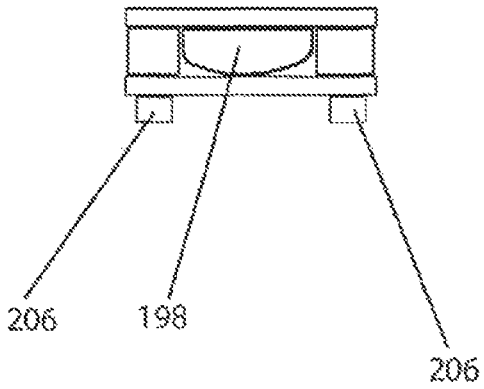
FIG. 34 is a side elevation view of the 23rd embodiment of a balance training system.

A skate training specific embodiment of the balance training system is shown schematically in FIG. 33. In this embodiment, the convex curved surface is attached to the platform and changes angle as the platform changes angle. This is to simulate the horizontal movement of the bottom of the foot when wearing skates and rolling one's ankles from side to side. The forward and backward movement of the foot in skates, however, does not result in the same horizontal movement of the ankle. For this reason, as shown in the side view in FIG. 33, the front to back contacting surface 196 curvature of the articulating member 198 is of a larger average radius than the side to side curvature as shown in the front view in FIG. 34. In this way, the embodiment in FIGS. 33 and 34 simulates this movement of the foot and lower extremities while skating and trains a skating specific proprioceptive response to imbalances.

In addition, a low friction interface with the ground or a lower surface 202 such as, but not limited to wheels 206 is preferable to allow low friction movement in the direction of the skate blade to recruit other balance and stability modes which are common to skating. The rolling member 200 is preferably self centering in some applications by soft springs 208 and or by a slightly concave rolling surface 202. The skate specific trainer can be used with or without a stability zone on the apex of the articulating member. Compressible members 204 can be used to increase the ease of use.

Figure 35:
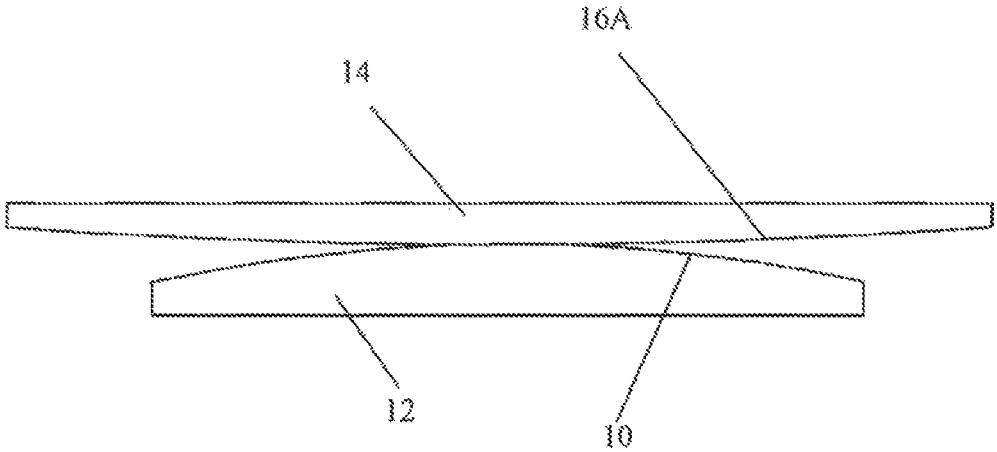
FIG. 35 is a side elevation view of a 24th embodiment of a balance training system.

In FIG. 35, an embodiment of the Balance training system is shown with a convex downward facing surface 16A on the platform 14. This provides the benefit of the balance training system as long as the downward facing surface is of a larger average radius than the upward facing surface 10 of the lower member 12. The stability zone can also be accomplished in this and other embodiments by changing the radius of curvature of the contacting member with the larger radius of curvature.

Other uses for this embodiment, preferably with less offset between the ground plane and the contact point, would include, but not be limited to, for cross country skiing.

One or more of the features for various effects disclosed herein can be combined to achieve various effects.

The balance training system may have tactile feedback systems to alert the user to an out of balance situation include lights, audible feedback, increasing vibration, or perceptible bumps that engage more dramatically as the user changes the angle of the platform at a greater angle from the stability zone.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

What is claimed is:

1. A balance training system, comprising:

a lower member having a ground contacting surface and an upward facing surface, the ground contacting surface providing stabilization of the lower member against tilting, the lower member and the upward facing surface being configured to maintain a fixed angular position relative to the ground in use;

an upper member having a foot receiving surface and a downward facing surface;

the upward facing surface of the lower member and the downward facing surface of the upper member being shaped for rolling contact with each other; and the upper member providing a support for a person to train balancing on when a balance point, line or area on one of the downward facing surface of the upper member and upward facing surface of the lower member is in contact with a respective apex of the other of the upward facing surface of the lower member and the downward facing surface of the upper member, in which, due to the upward facing surface and the downward facing surface being shaped for rolling contact with each other, the balance point, line, or area in use travels along the upward facing surface and along the downward facing surface during tilting of the upper member.

2. The balance training system of claim 1 in which one or more portions of one or both of the upward facing surface and the downward facing surface are convex and the upward facing surface and the downward facing surface are shaped for contact with each other at least along the one or more portions of one or both of the upward facing surface and the downward facing surface.

3. The balance training system of claim 1 in which the upper member and lower member have a contact interface that is curved to provide differential tilting in a first direction and a second direction different from the first direction.

4. The balance training system of claim 1 in which:

the downward facing surface has a first radius of curvature at the balance point, line or area or is flat with infinite radius of curvature;

the upward facing surface has the apex and a second radius of curvature at the apex; and the second radius of curvature is smaller than the first radius.

5. The balance training system of claim 1 in which one or both of the upward facing surface and the downward facing surface includes a stability zone formed by the respective upward facing surface or the downward facing surface having decreasing radius of curvature with distance from the respective apex or balance point.

6. The balance training system of claim 5 in which the stability zone is formed by a flat or concave area in the upward facing surface.

7. The balance training system of claim 4 in which one or both of the upward facing surface and the downward facing surface includes a rocker zone formed by the respective upward facing surface or the downward facing surface having increasing radius of curvature with distance from the respective apex.

8. The balance training system of claim 2 in which the one or more convex portions are spaced on either side of the foot receiving surface of the upper member.

9. The balance training system of claim 1, in which the lower member comprises compressible material fixed to both the lower member and the upper member, and being differentially compressible to provide increasing force resisting tilting.

10. The balance training system of claim 1 where the upper member is biased to a position by a spring force.

11. The balance training system of claim 10 where the spring force is adjustable.

12. The balance training system of claim 1 in which the foot receiving surface of the upper member is vertically spaced from the upward facing surface by less than 1" when the balance point, line, or area on the one of the upper member and the lower member is in contact with the apex of the other of the upper member or the lower member.

13. The balance training system of claim 1 in which the upper member has rolling contact with the lower member in only one direction.

14. The balance training system of claim 1 in which the upper member has rolling contact with the lower member in more than one direction.

15. A balance training system, comprising:

a lower member having a ground contacting surface and an upward facing surface, the ground contacting surface providing stabilization of the lower member against tilting;

an upper member having a foot receiving surface and a downward facing surface;

the upward facing surface and the downward facing surface being shaped for rolling contact with each other; and the upper member providing a support for a person to train balancing on when a balance point, line, or area on one of the upper member and the lower member is in contact with a respective apex of the other of the upper member or the lower member, in which, due to the upward facing surface and the downward facing surface being shaped for rolling contact with each other, the balance point, line, or area travels along the upward facing surface and along the downward facing surface during balancing, in which the foot receiving surface is recessed downward to be level with the apex at the contact between the upper member and the lower member when the balance point, line, or area on the one of the upper member and the lower member is in contact with the apex of the other of the upper member or the lower member.

16. An angle change platform with an upper member having a foot receiving surface and a flat or curved downward facing surface in rolling contact along a contact interface with a lower member having a convex upward facing surface and an apex, and the lower member being stabilized against tilting, the contact interface extending along the convex upward facing surface and in which the foot receiving surface is vertically spaced from the apex by less than 1" when the flat or curved downward facing surface is in contact with the apex of the lower member.

17. The angle change platform of claim 16, the foot receiving surface being vertically aligned with the apex of the convex upward facing surface.

18. The angle change platform of claim 16 in which the upper member is constrained to be able to change angle on only one plane.

19. The angle change platform of claim 16 in which the convex upward facing surface has a radius of curvature between 7 cm and 25 cm.

20. The angle change platform of claim 16 in which the foot receiving surface is vertically spaced from the apex by less than 10 mm.

21. The angle change platform of claim 16 in which the convex upward facing surface includes a stability zone formed by the convex upward facing surface having decreasing radius of curvature with increasing distance from the apex.

22. The angle change platform of claim 16 in which the convex upward facing surface is configured so that the contact interface extends a greater distance for a given platform angle change in a first direction than the contact interface extends for the given platform angle change in a second direction that is 90 degrees to the first direction.

23. The angle change platform of claim 16 in which the upper member is constrained to be able to change angle on only one plane by straps extending between the upper member and the lower member.

24. The angle change platform of claim 16 in which the upper member is constrained to be able to change angle on only one plane by a bearing arrangement.

* * * * *